United States Patent [19]

Kurokawa et al.

[11] Patent Number: 4,844,343

[45] Date of Patent: Jul. 4, 1989

[54] ULTRASONIC VIBRATOR HORN

[75] Inventors: Hitoshi Kurokawa; Kouji Nakayama, both of Saitama; Hirokazu Takenaka, Hachioji, all of Japan

[73] Assignee: Toa Nenryo Kogyo Kabushiki Kaisha, Tokyo, Japan

[21] Appl. No.: 79,736

[22] Filed: Jul. 30, 1987

[30] Foreign Application Priority Data

Aug. 1, 1986 [JP] Japan ..... 61-180164

[51] Int. Cl.[4] ..... B05B 17/06

[52] U.S. Cl. ..... 239/102.2; 310/323

[58] Field of Search ..... 239/102.2, 4; 310/323

[56] References Cited

U.S. PATENT DOCUMENTS

| | | | |
|---|---|---|---|
| 578,461 | 3/1897 | Mertz | 239/498 |
| 1,659,538 | 2/1928 | Angrove . | |
| 1,730,664 | 10/1929 | Kruse | 239/590.5 |
| 1,758,119 | 5/1930 | Le Moon | 239/460 |
| 1,954,173 | 4/1934 | Histed | 239/489 |
| 2,005,600 | 6/1935 | Tappen | 299/121 |
| 2,596,341 | 5/1952 | McCreery et al. | 239/590.5 |
| 2,712,962 | 7/1955 | Goddard | 239/500 X |
| 2,779,623 | 1/1957 | Eisenkraft | 239/1 |
| 3,110,444 | 11/1963 | Eakins | 239/500 |
| 3,145,931 | 8/1964 | Cleall | 239/102.2 |
| 3,317,139 | 5/1967 | Freeland | 447/634 |
| 3,373,752 | 3/1968 | Inoue | 239/4 |
| 3,749,318 | 7/1973 | Cottell | 239/102 |
| 3,756,575 | 9/1973 | Cottell | 261/1 |
| 4,153,201 | 5/1979 | Berger et al. | 239/4 |
| 4,197,997 | 4/1980 | Wu et al. | 239/102 |
| 4,350,302 | 9/1982 | Gruber et al. | 239/500 |
| 4,372,491 | 2/1983 | Fishgal | 239/102 |
| 4,389,999 | 6/1983 | Jaqua | 123/536 |
| 4,402,458 | 9/1983 | Lierke et al. | 239/102 |
| 4,403,741 | 9/1983 | Moriya et al. | 239/585 |
| 4,408,722 | 10/1983 | Freland | 239/533.12 |
| 4,473,187 | 9/1984 | Lierke et al. | 239/102 |
| 4,474,326 | 10/1984 | Takahashi | 239/102 |
| 4,496,101 | 1/1985 | Northman | 239/102 |
| 4,501,406 | 2/1985 | Walther et al. | 251/30 |
| 4,541,564 | 9/1985 | Berger et al. | 239/102 |
| 4,607,239 | 8/1986 | Ballato | 331/176 |
| 4,689,515 | 8/1987 | Benndorf et al. | 310/316 |
| 4,690,332 | 9/1987 | Hughes | 239/590.3 |
| 4,726,524 | 2/1988 | Ishikawa et al. | 239/102.2 |

FOREIGN PATENT DOCUMENTS

| | | | |
|---|---|---|---|
| 752747 | 2/1967 | Canada . | |
| 202102 | 11/1986 | European Pat. Off. | 239/102.2 |
| 2239408 | 2/1974 | Fed. Rep. of Germany | 313/239 |
| 803553 | 10/1936 | France . | |
| 144826 | 1/1962 | U.S.S.R. . | |
| 589031 | 1/1978 | U.S.S.R. . | |
| 2073616 | 10/1981 | United Kingdom . | |

*Primary Examiner*—Andres Kashnikow
*Assistant Examiner*—Michael J. Forman
*Attorney, Agent, or Firm*—Seidel, Gonda, Lavorgna & Monaco

[57] ABSTRACT

An ultrasonic vibrator horn for use with ultrasonic atomizing apparatus for atomizing liquids, such as liquid fuels, employed in gasoline engines, diesel engines, gas turbines and various combustors such as industrial, commercial and domestic boilers. The ultrasonic vibrator horn has a body portion connected at one axial end thereof to an ultrasonic vibration generating means. The other axial end of the body, at which atomization of liquid material fed to the horn takes place when the horn is driven by the vibration generating means, is of conical shape. The body has at least one external groove formed in it. The groove communicates with the conical end of the body for receiving the liquid material and directing it to the conical end.

7 Claims, 5 Drawing Sheets

ULTRASONIC VIBRATOR HORN

TECHNICAL FIELD

This invention relates generally to an ultrasonic vibrator horn, and particularly to an ultrasonic vibrator horn for use with ultrasonic atomizing apparatus for atomizing liquid, such atomizing apparatus including industrial and non-industrial liquid atomizing apparatus employed with gasoline engines, diesel engines, gas turbines and various combustors such as industrial, commercial and domestic boilers.

BACKGROUND ART

An ultrasonic vibrator horn used on the ultrasonic atomizing apparatus of the type described is typically connected to an electroacoustic transducer which, together with a high frequency oscillator forms ultrasonic vibration generating means. High frequency electric oscillations produced by the high frequency oscillator as it is driven are applied to the electroacoustic transducer which converts the electric vibrations into ultrasonic vibrations which are used to atomize liquid feed. With the ultrasonic vibrator horn of the type described above, it is known that the atomization properties such as the flow rate of spray of liquid material such as liquid fuel as it is atomized upon being fed from a liquid feeding mechanism in the ultrasonic atomizer and the particle size of the atomized droplets will have various effects on the performances of combustors such as boilers, gasoline engines and the like in which the ultrasonic atomizer is used. By way of example, poor atomizing properties of the ultrasonic vibrator horn can make it impossible to effect positive control of the ratio of air and fuel, or deteriorate the combusting conditions to result in an increase in the content of hydrocarbon and carbon monoxide in the exhaust gases as well as an increase in soots produced.

In order to eliminate such problems with the combustion apparatus it is required to improve the atomizing characteristics of the ultrasonic vibrator horn as described above.

To this end, various improvements on the ultrasonic vibrator horn have been heretofore proposed as illustrated in FIGS. 6A–D and 7A–C.

The prior art vibrator horn 109 shown in FIG. 6A is characterized by a plurality of flutes or longitudinal grooves 107 formed in the peripheral surface of the horn for receiving and directing liquid fuel from the feed point of liquid fuel, that is, from the liquid feed mechanism or fuel feed pipe 103 positioned adjacent the periphery of the horn towards the forward end of the horn. The grooves 107 are either V-shaped in cross-section as shown in FIG. 6B, or U-shaped as shown in FIG. 6C, or channel-shape as shown in FIG. 6D. The grooves may extend parallel to the central axis of the horn or may alternatively be inclined progressively towards the central axis as it proceeds towards the forward end of the vibrator horn 109, as required. The grooves 107 formed in the outer periphery of the vibrator horn 109 are designed to direct the liquid fuel fed to the vibrator horn towards the forward end of the horn which defines an atomizing area, to prevent the liquid fuel from dropping off the horn before reaching the forward end thereof even when the horn is disposed in a horizontal orientation, and to provide an increased surface area and an enhanced cooling effect.

The proposal as illustrated in FIGS. 7A–7C comprises one or more longitudinal grooves 117 formed in the peripheral surface of the ultrasonic vibrator horn 119 of the type which has equal-diameter multiple-stepped edged portions extending from a point intermediate the ends of the horn to the forward end. The groove or grooves 117 are either V-shaped, or U-shaped, or channel-shaped in cross-section and extend from the feed point of liquid fuel discharged from a feed pipe 113 to the edged portion one step short of the foremost edged portion for receiving and directing the liquid fuel. The grooves 117 may extend parallel to the central axis of the horn 119 or may be inclined progressively towards the central axis as it proceeds towards the forward end of the vibrator horn, as required. The grooves 117 formed in the outer periphery of the vibrator horn 119 are designed to direct the liquid fuel fed to the horn towards the equal-diameter multiple-stepped edged portions which define the atomizing area of the horn, to prevent the liquid fuel from dropping off the horn before reaching the edged portions even when the horn is disposed in a horizontal orientation, to ensure good distribution of fuel over the edged portions and hence stable atomization of fuel, and to provide an increased surface area and an enhanced cooling effect. The foremost edged step devoid of grooves serves as a stop to keep the fuel flowing along the grooves 117 from flying off or flowing out of the atomizing area.

With the ultrasonic vibrator horn 109 according to the proposal as illustrated in FIG. 6A, however, the atomizing area for atomizing the liquid fuel as supplied from the feed pipe 103 is limited to the forward end portion of the vibrator horn 109, so that when the horn is disposed in a horizontal position as shown in FIGS. 8A and 8B, the spatial extent F of spread of the atomized droplets is restricted to a narrow strip of space extending generally straight forward from the horn 109, resulting in a relatively low rate of spray or atomization and disadvantageously large particle size of atomized droplets. With the ultrasonic vibrator horn 119 according to the proposal as illustrated in FIGS. 7A–7C, the atomizing area for atomizing the liquid fuel as supplied from the fuel feed pipe 113 extends over all the edged portions except the foremost one so that the atomizing area is considerably larger than that of the vibrator horn 109 shown in FIGS. 8A and 8B. Consequently, when the horn 119 is oriented in a horizontal position as shown in FIGS. 9A and 9B, it provides an adequately wide extent F of spread of atomized droplets. However, if the feed point of liquid fuel from the feed pipe 113 to the vibrator horn 119 is changed, or if the flow rate of fuel supply varies, then the spatial extent of spray spread will vary, so that the spray spread extent F is unstable.

As a result of extensive researches and experiments conducted to overcome the aforesaid problems with the prior art, the present inventors have found out that in an ultrasonic vibrator horn having groove means formed in the outer periphery of the horn, said groove means communicating with the axially forward end portion and adapted to receive and direct liquid fuel as fed thereto toward said forward end portion, it is advantageous to make the end portion of the horn conical in shape so that the atomization of the liquid fuel takes place at the conical forward end portion and in its vicinity, and that the spacial extent of spray spread of the liquid fuel extends over an angle of 180° minus the vertical angle $\alpha$ of the conical forward end portion of the vibrator horn. The inventors have thus discovered that it is possible to define an optimal spatial extent of spray spread depending on the size and configuration of the combusting apparatus, for example, with which the vibrator horn is used by setting the vertical angle of the conical forward end portion of the horn at an appropriate value.

The present invention is based on such novel discovery.

SUMMARY OF THE INVENTION

Accordingly, an object of the present invention is to overcome the aforesaid problems with the conventional ultrasonic vibrator horn, and a specific object is to provide an ultrasonic vibrator horn which may be designed to provide an optimum spatial extent of spray spread according to the size, etc. of the various apparatus with which the vibrator horn is used.

The foregoing objects may be accomplished by the ultrasonic vibrator horn according to the present invention.

Briefly, this invention consists in an ultrasonic vibrator horn connected at one axial end thereof to an ultrasonic vibration generating means, the other axial end portion of the horn at which atomization of liquid material fed to the horn takes place when the horn is driven by said vibration generating means being of conical shape, said horn having groove means formed in the outer periphery of the horn, said groove means communicating with said other axial end portion for receiving the liquid material fed to the horn and directing the liquid material to the other axial end portion.

An embodiment of the present invention will now be described by way of example but not by way of limitation with reference to the accompanying drawings.

DESCRIPTION OF THE EMBODIMENT

Figure 1A:
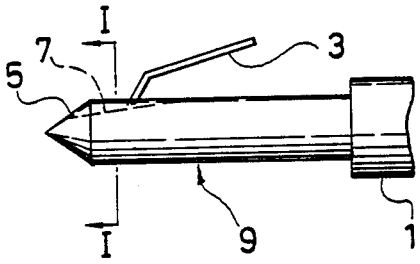
FIG. 1A is a side view of one embodiment of the ultrasonic vibrator horn according to the present invention.

Referring to the drawings, particularly FIGS. 1A–1D, one embodiment of the ultrasonic vibrator horn for an ultrasonic atomizer according to the present invention is illustrated. As shown in FIG. 1A, the ultrasonic vibrator horn 9 is connected at its one axial end to an electroacoustic transducer 1 which forms part of an ultrasonic vibration generating means. According to this invention, the other axially forward end portion 5 of the horn at which atomization of liquid fuel fed from a fuel feed pipe 3 to the horn takes place when the horn is driven by the vibration generating means is formed into a conical shape. The horn further has one or more circumferentially spaced longitudinal grooves 7 formed in its outer periphery. The groove 7 communicates with the forward end portion 5 for receiving liquid fuel from the feed pipe 3 and directing the same to the end portion 5. In FIG. 1A the groove 7 is shown as being inclined progressively towards the central axis of the horn as it proceeds towards the forward end 5, but the groove may extend parallel to the central axis of the horn 9 and there may be provided a plurality of grooves.

Figure 1B:
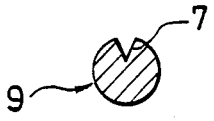
FIG. 1B, 1C and 1D are cross-sectional views taken along line I—I in FIG. 1A and show cross-sectional shapes of groove formed in the outer periphery of the vibrator horn shown in FIG. 1A.
Figure 1C:
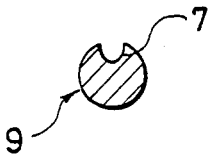
Figure 1D:
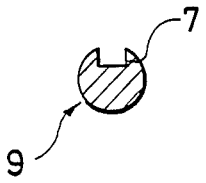

The groove 7 may be either V-shaped in cross-section as shown in FIG. 1B, or U-shaped as shown in FIG. 1C, or channel-shaped as shown in FIG. 1D.

As indicated above, the forward end portion 5 of the vibrator horn 9 at which atomization of liquid fuel takes place is conical in shape. The vertical angle of the conical forward end portion 5 may be set at a value desired to suit the size and configuration of a combustor or the like with which the vibrator horn 9 is used so that the horn provides optimal spray characteristics, that is, an optimal spatial extent of spread of spray according to the size and configuration of the combustor.

Figure 2:
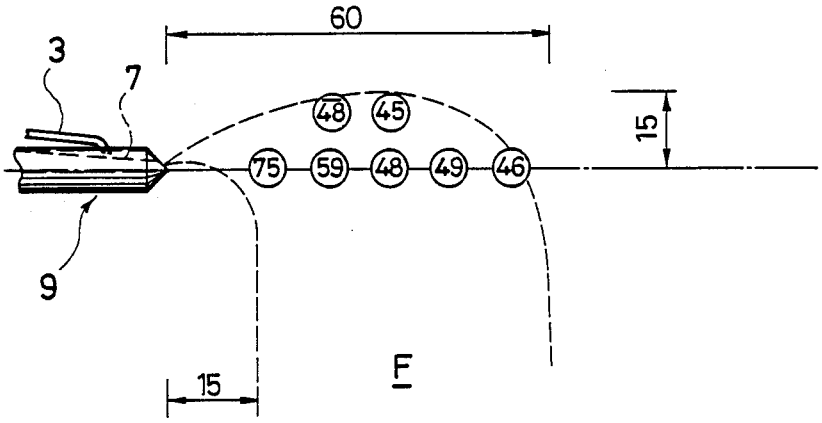
FIG. 2 is a diagrammatical side view showing the spatial extent of spread of the spray as discharged from the vibrator horn of FIG. 1A.
Figure 3:
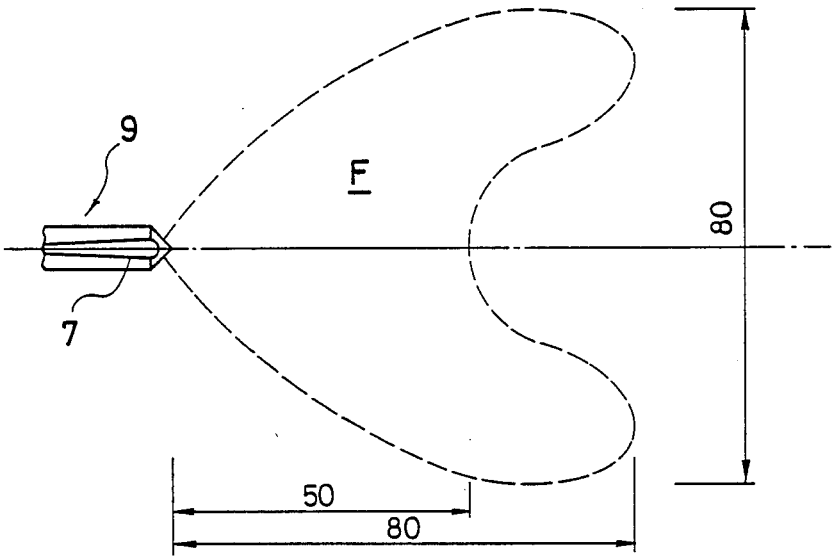
FIG. 3 is a diagrammatical plan view showing the spatial extent of spread of the spray discharged from the vibrator horn of FIG. 1A.

The ultrasonic vibrator horn 9 constructed as described above has been created on the basis of the results of experiments conducted by the present inventors as illustrated in FIGS. 2 and 3. In the experiments kerosene was used as liquid fuel and supplied to the vibrator horn at a flow rate of 0.08 cc/sec. It was an ultrasonic vibrator horn made of carbon steel or low-alloy steel and having a conical forward end with a vertical angle of 90° and a longitudinal groove that was used for the experiments. It exhibited a spatial extent F of spray spread as shown in FIG. 2 when viewed in a side view and as shown in FIG. 3 when viewed in a plan view. It was also found that the horn provided a distribution of particle sizes of spray droplets as shown in FIG. 2 (in which the circled digits represent the SMD).

Figure 4A:
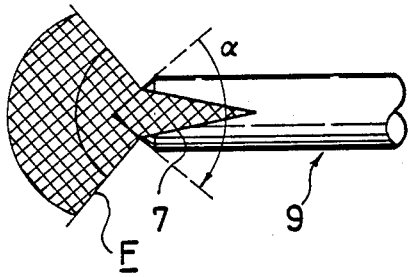
FIG. 4A and 4B are diagrammatical plan views showing the relation between the spatial extent of spread of the spray discharged from the horn of FIG. 1A and the included angle of conical end portion of the horn.
Figure 4B:
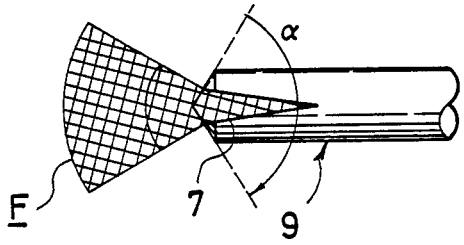

Through these experiments it was observed that when viewed in a top plan view, liquid fuel was guided along the groove 7 to the conical forward end portion 5 of the horn 9 where the fuel spread over between two lines each extending perpendicular to the respective one of two opposed sides defining the apex of the conical surface of the end portion 5 of the horn, as shown in FIGS. 4A and 4B.

This has led the present inventors to the conclusion that in an ultrasonic vibrator horn having groove means formed in the outer periphery thereof, said groove means communicating with the axially forward end portion and adapted to receive and direct liquid fuel as fed thereto toward said forward end portion, when the forward end portion of the horn is made conical in shape, atomization of the liquid fuel takes place at the conical forward end portion and in its vicinity, and the spatial extent F of spray spread of the liquid fuel extends over an angle of 180° minus the vertical angle $\alpha$ of the conical forward end portion of the vibrator horn.

Figure 5A:
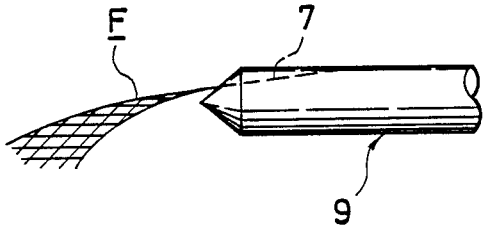
FIGS. 5A and 5B are side views showing the spatial extent of spread of the spray discharged from the horn of FIG. 1A
Figure 5B:
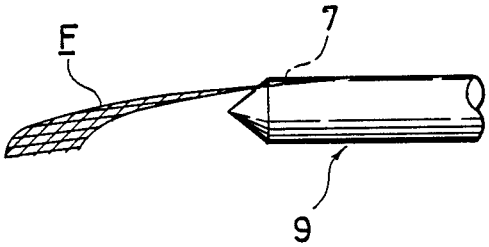
Figure 6A:
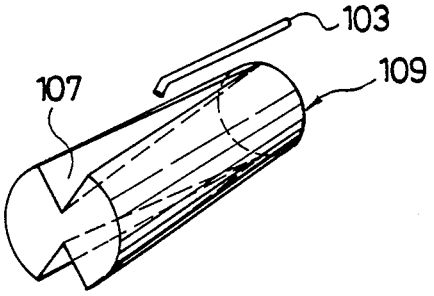
FIG. 6A PRIOR ART
FIG. 6A is a perspective view of a prior art ultrasonic vibrator horn.
Figure 6B:
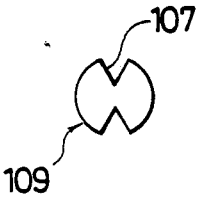
FIG. 6B PRIOR ART
FIGS. 6B, 6C and 6D are end views of the horn as shown in FIG. 6A for showing cross-sectional shapes of grooves formed in the outer periphery of the horn.
Figure 6C:
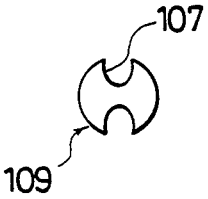
FIG. 6C PRIOR ART
Figure 6D:
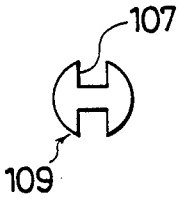
FIG. 6D PRIOR ART
Figure 7A:
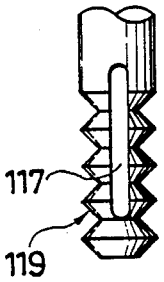
FIG. 7A PRIOR ART
FIG. 7A is a side view of another prior art ultrasonic vibrator horn.
Figure 7B:
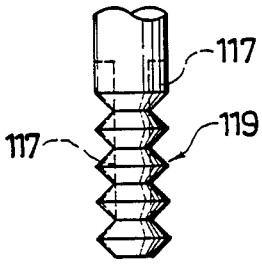
FIG. 7B PRIOR ART
FIG. 7B is a side view of the vibrator horn as rotated 90° from the position shown in FIG. 7A about its axis.
Figure 7C:
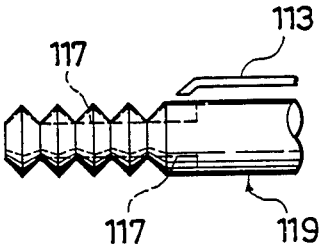
FIG. 7C PRIOR ART
FIG. 7C is a side view of the vibrator horn of FIG. 7B disposed in a horizontal position.
Figure 8A:
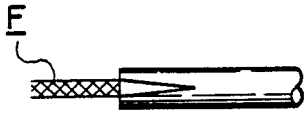
FIG. 8A PRIOR ART
FIG. 8A is a plan view of the prior art vibrator horn shown in FIGS. 6A–6D illustrating the spatial extent of the spray spread.
Figure 8B:
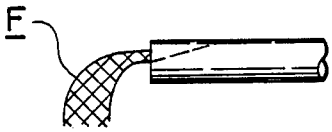
FIG. 8B PRIOR ART
FIG. 8B is a side view of the prior art vibrator horn shown in FIGS. 6A–6D illustrating the spatial extent of the spray spread.
Figure 9A:
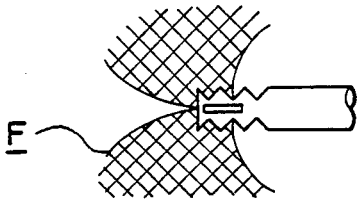
FIG. 9A PRIOR ART
FIG. 9A is a plan view of the other vibrator horn shown in FIGS. 7A–7C illustrating the spatial extent of the spray spread.
Figure 9B:
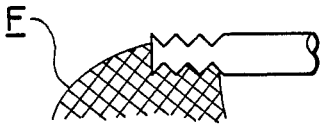
FIG. 9B PRIOR ART
FIG. 9B is a side view of the other vibrator horn shown in FIGS. 7A–7C illustrating the spatial extent of the spray spread.

On the basis of the foregoing conclusion the inventors have discovered that it is possible to define the spatial extent F of spray spread desired to suit the size and configuration of the combustor, for example, with which the vibrator horn 9 is used, by setting the vertical angle of the conical forward end portion of the horn at an appropriate value, as shown in FIG. 1. Furthermore, as the spray F spreads in a flat manner as shown in FIGS. 5A and 5B, it provides another advantage of facilitating combustion of the fuel.

It is thus to be appreciated that the present invention provides a novel and improved ultrasonic vibrator horn characterized by a forward end portion at which atomization of liquid material fed to the horn takes place when the horn is driven by ultrasonic vibration generating means being conical in shape, and groove means formed in the outer periphery of the horn, said groove means intersecting with said conical forward end portion for receiving the liquid material fed to the horn and directing the same to the forward end portion, whereby the horn may provide an optimal spatial extent of spray spread suitable for the size and configuration of various types of apparatus in which an ultrasonic atomizer incorporating the vibrator horn is used.

We claim:

1. An ultrasonic vibrator horn having a body portion connected at one axial end thereof to an ultrasonic vibration generating means, the other axial end portion of the body at which atomization of liquid material fed to the horn takes place when the horn is driven by said vibration generating means being of conical shape, said body having external groove means formed therein, said groove means communicating with said other axial end portion for receiving the liquid material fed to the horn and directing the liquid material to the other axial end portion.

2. The ultrasonic vibrator horn of claim 1 in which said groove means is V-shaped in cross-section, and comprises at least one extending parallel to the central axis of said horn.

3. The ultrasonic vibrator horn of claim 1 in which said groove means is V-shaped in cross-section, and comprises at least one grooves inclined towards the central axis of said horn as the at least one groove proceeds towards said axial end portion.

4. The ultrasonic vibrator horn of claim 1 in which said groove means is U-shaped in cross-section, and comprises at least one groove extending parallel to the central axis of said horn.

5. The ultrasonic vibrator horn of claim 1 in which said groove means is U-shaped in cross-section, and comprises at least one groove inclined towards the central axis of said horn as the at least one groove proceeds toward said axial end portion.

6. The ultrasonic vibrator horn of claim 1 in which said groove means is channel-shaped in cross-section, and comprises at least one groove extending parallel to the central axis of said horn.

7. The ultrasonic vibrator horn of claim 1 in which said groove means is channel-shaped in cross-section, and comprises at least one groove inclined towards the central axis of said horn as the at least one groove proceeds toward said axial end portion.

* * * * *